United States Patent [19]

Curry et al.

[11] 4,073,038

[45] Feb. 14, 1978

[54] PINTLE WITH ADJUSTABLE SPRING TENSION MOTOR

[75] Inventors: Edward G. Curry; Vernard W. Sanders, both of Los Angeles, Calif.

[73] Assignee: Henry Soss and Company, Los Angeles, Calif.

[21] Appl. No.: 730,341

[22] Filed: Oct. 7, 1976

[51] Int. Cl.[2] ..... E05F 1/12

[52] U.S. Cl. ..... 16/189; 16/50

[58] Field of Search ..... 16/189, 128 R, 176, 16/50, 168, 169, 180

[56] References Cited

U.S. PATENT DOCUMENTS

| | | | |
|---|---|---|---|
| Re. 6,112 | 11/1874 | Joyce | 16/189 |
| 1,912,289 | 5/1933 | March | 16/189 |
| 3,255,484 | 6/1966 | MacDonald | 16/180 |
| 3,903,567 | 9/1975 | Suska | 16/189 |
| 3,978,551 | 9/1976 | Mochizuki | 16/189 |

FOREIGN PATENT DOCUMENTS

| | | | |
|---|---|---|---|
| 985,860 | 3/1976 | Canada | 16/50 |
| 1,961,736 | 6/1971 | Germany | 16/189 |

*Primary Examiner*—James Kee Chi

[57] ABSTRACT

A tension spring motor for use in a pintle or cartridge like container is employed to return hinged parts to an initial position after having been rotated to a second position. Door hinges are a typical example where a spring automatically returns the door to closed position after it has been opened. To vary the tension in the spring use is made of a pair of notched members housed within the pintle, one being a fixed member and the other being a movable member attached to the spring and rotatable tc different positions of adjustment. A wrench hold in the movable member is accessible from the outside through a hole in the fixed member.

11 Claims, 7 Drawing Figures

PINTLE WITH ADJUSTABLE SPRING TENSION MOTOR

The present invention relates in general to pintles frequently referred to as hinge pins. More specifically, the invention is directed to a pintle containing a spring motor wherein the bias of the spring can impart motion to an adjacent object such as a spring hinge for closing a door.

Helical torsion springs acting as door closing devices have been in widespread use for sometime. Recent marketing trends have dictated that the aesthetic appearance of hinges employing such springs is an important factor and it is most desirable that they be similar in size, shape and appearance to conventional hinges which do not contain such springs.

The present invention approaches this problem by creating a pintle with the spring elements being self-contained, which results in an item that is easily assembled, or if need be disassembled, with the cooperating adjacent elements, such as a pair of hinge leaves.

The pintle of the present invention is basically a tubular component containing a helical wound torsion spring, means for attachment at each end of the spring, an adjusting device for selectively pretensioning the spring, and means to mechanically interconnect the tubular portion of one hinge leaf and one of the end attachments to the other hinge leaf, and a ratcheting interconnection between the other end attachment and the tubular elements.

By design the pretensioning device is such that adjustment can be accomplished by means of a simple tool such as a common hexagonal socket key.

Recent U.S. patents covering similar structures are U.S. Pat. Nos. 3,825,973 and 3,903,567. In both of these patents an even number of hinge leaf knuckles are employed, U.S. Pat. No. 3,825,973 using four and U.S. Pat. No. 3,903,567 using two, thus providing a structure which attaches the torsion spring with ease to respective opposite leaves. The present invention is such that the more conventional structure of hinges with three or five knuckles can be utilized.

It is further apparent that the structures of U.S. Pat. No. 3,825,973 and U.S. Pat. No. 3,903,567 are not designed to enjoy the ease of assembly and disassembly offered by the structure of the present invention. These features can be of great advantage during manufacture and assembly and as well to the installer. There is also an advantage when future field service becomes necessary. Most such structures currently available would require complete replacement in case of failure. The present invention on the contrary requires only replacement of the spring containing pintle.

Among the objects of the invention is therefor to provide a new and improved composite hinge pintle of no greater length and size than a conventional hinge pintle but which is provided with a spring motor. Another object of the invention is to provide a new and improved composite pintle of cylindrical form and size substantially the same as conventional pintles and wherein a spring motor is provided the tension of which is capable of being varied by an appropriate tool.

Still another object of the invention is to provide a new and improved pintle of cartridge-like form capable of being used as the pintle for the hinges wherein the pintle is a composite construction adapted to be inserted into axially aligned chambers in respective knuckles, the pintle being one equipped with a spring motor readily adjusted for either greater or lesser tension by a tool applied from the exterior.

Still another object of the invention is to provide a new and improved composite hinge pintle containing appropriate adjustable spring motor which is insertable through one exterior hinge knuckle into the other knuckle and appropriately anchored in place and wherein for extra duty needs there is a supplemental spring device encompassed within a conventional coil torsion spring.

With these and other objects in view, the invention consists in the construction, arrangement, and combination of the various parts of the device and method, whereby the objects contemplated are attained, as hereinafter set forth, pointed out in the appended claims and illustrated in the accompanying drawings.

Figure 1:
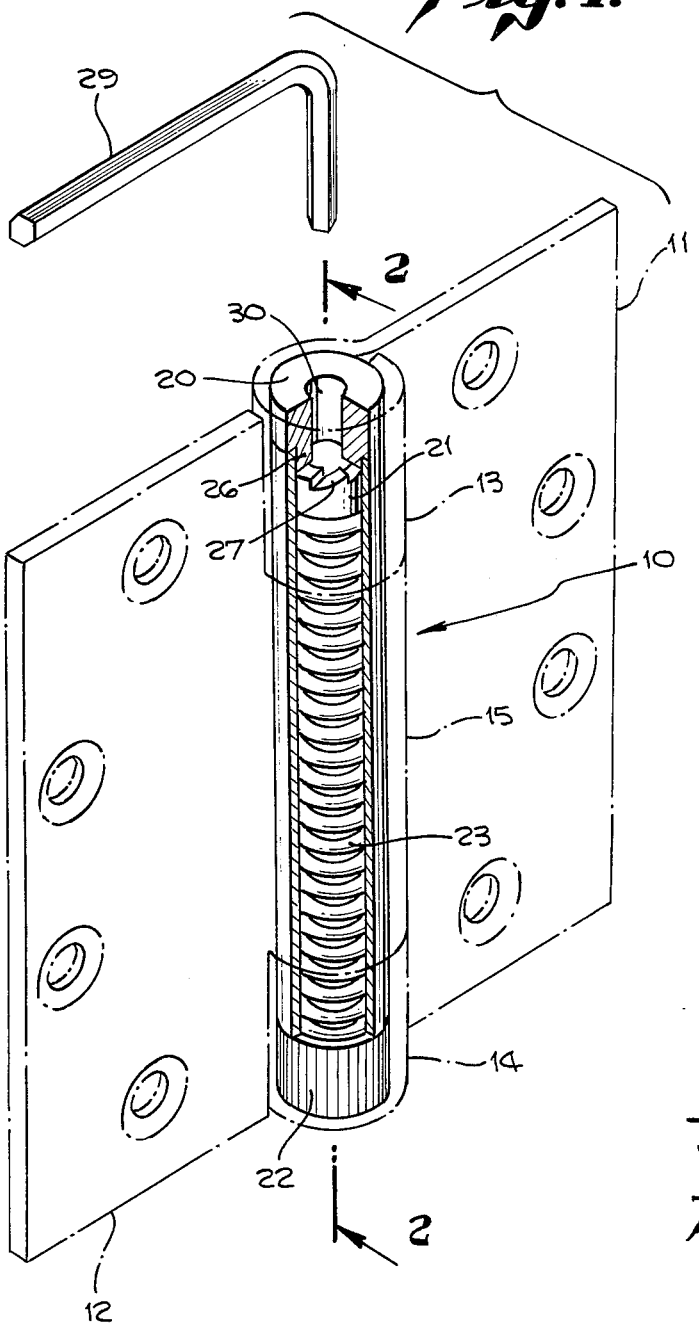
FIG. 1 is a perspective view of a composite pintle, partially cut away, and indicated in phantom lines, its relationship with a pair of hinge leaves.

In an embodiment of the invention chosen for the purpose of illustration there is shown a composite pintle indicated generally by the reference character 10. Although the composite pintle in the form shown is useful as a spring motor for changing the position of any two mutually pivoted parts, a pair of respective female and male hinge leaves 11 and 12 are shown by way of example.

The female hinge leaf 11 provides respective upper and lower knuckles 13 and 14 between which is located a center knuckle 15 of the male hinge, the knuckle providing axially aligned bores or chambers 16, 17, and 18 which accommodate the composite pintle 10. Connected together in the manner shown the composite pintle acting as the spring motor can act to automatically rotate the hinge leaves to close a door.

Figure 5:
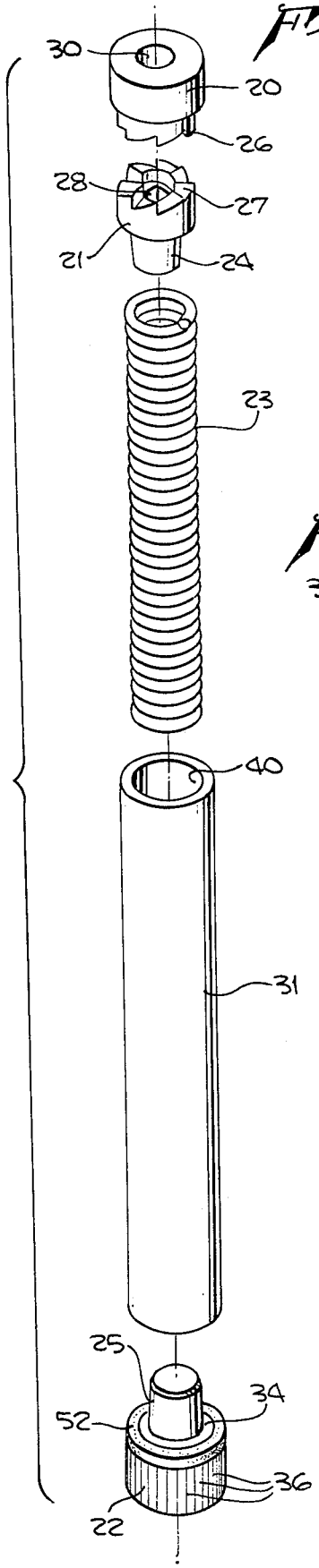
FIG. 5 is an exploded perspective view of the components of FIGS. 1 and 2.
Figure 2:
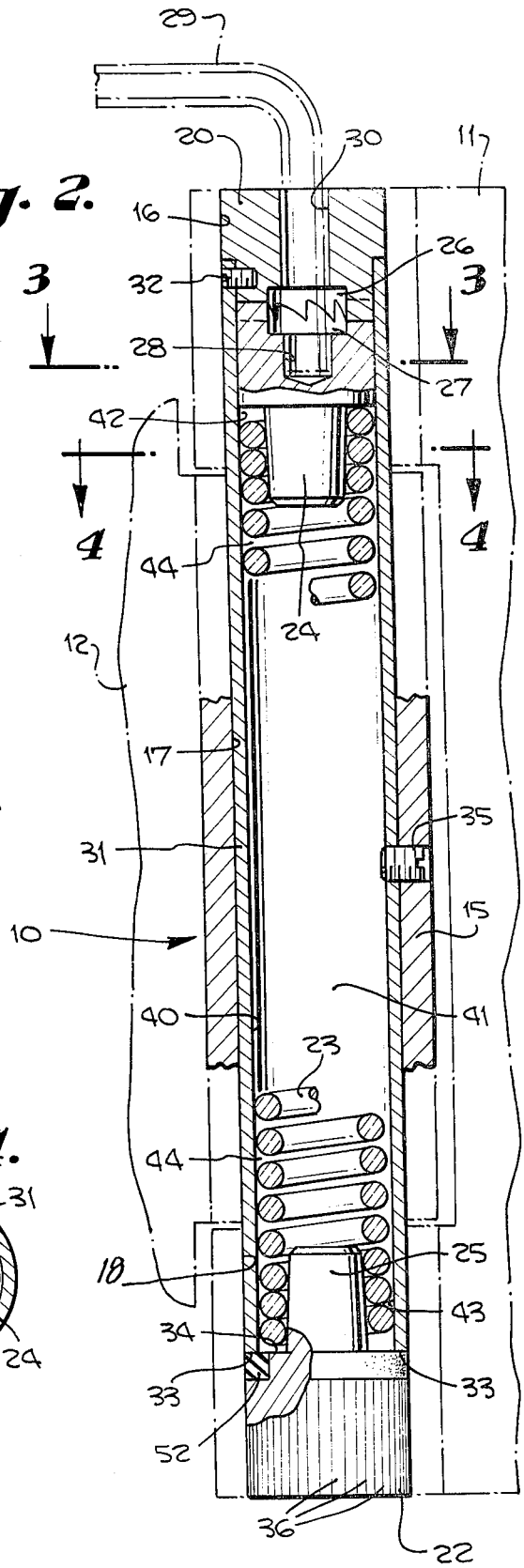
FIG. 2 is a longitudinal sectional view in greater detail and showing a wrench in place.
Figure 3:
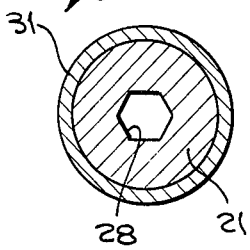
FIG. 3 is a cross-sectional view on the line 3—3 of FIG. 2.
Figure 4:
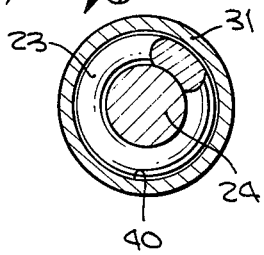
FIG. 4 is a cross-sectional view on the line 4—4 of FIG. 2.

The composite pintle, shown in substantial detail in FIGS. 2 and 5 consists of an upper end piece or plug 20 arranged in adjustable relationship with a connecting member 21 and a lower end piece 22 between which is located a coiled torsion spring 23.

For holding the spring in engagement the connecting member 21 is provided with a tapered projection 24 to which is attached close wound coils of the spring numbering three in the chosen example. At the lower end there is a similar tapered projection 25 on the lower end piece 22 with which the lowermost close wound coils are engaged also numbering three in the chosen embodiment. The coils of the spring intermediate the projection are spaced apart at a calculated distance.

On the lower side of the upper end piece 20 is a series of ratchet teeth 26 which are adapted to mesh with a complementary set of ratchet teeth 27 on the upper side of the connecting member 21. In the connecting member 21 is a hexagonal socket 28 for reception of a conventional hexagonal wrench 29. Access is had to the hexagonal socket 28 through an aperture 30 in the upper end piece 20. The connecting member 21 is rotatable relative to the upper end piece 20.

To complete the construction of the composite pintle there is provided a tubular housing 31, the upper end of which is anchored to the upper end piece 20 by some conventional means as for example a set screw 32. The tubular housing 31 acting together with the upper end piece 20 is rotatable relative to the lower end piece 22 where a lower end edge 33 of the tubular housing 31 engages an upwardly facing shoulder 34 of the lower end piece. When the composite spindle 10 is mounted as shown to interconnect mutually rotatable hinge leaves 11 and 12 the tubular housing 31 is anchored to the center knuckle 15 of the male leaf by some conventional means such as a set screw 35. The lower end piece is anchored to the lower knuckle 14 of the female leaf 11 also by means of some acceptable conventional means as for example a series of serrations 36 which are forced into engagement with the interior of the axially aligned bore 18. Anchored as described the lower end piece 22 rotates with the female hinge leaf 11 and the tubular housing 31 and upper end piece 22 rotate with the male hinge leaf 12.

As a further aid in containment of the coil spring 23 the inside cylindrical wall 40 of the tubular housing 31, providing as it does a chamber 41, has a diameter slightly larger than the outside diameter of the coils of the coil spring 23. It follows further that at the upper end there is provided an annular recess 42 between the tubular housing and the tapered projection 24 which accommodates the close wound coils, there being a similar annular recess 43 at the lower end formed between the tubular housing and tapered projection 25 to accommodate the lowermost close wound coils.

Figure 6:
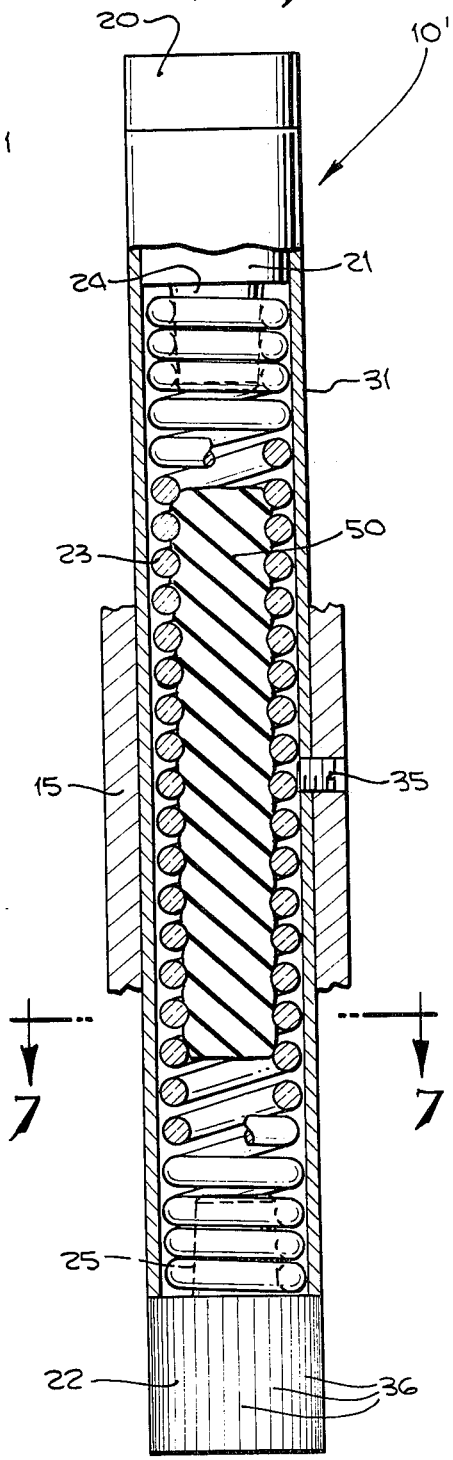
FIG. 6 is a longitudinal sectional view of a modified form of the invention.
Figure 7:
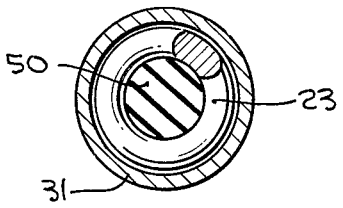
FIG. 7 is a cross-sectional view on the line 7—7 of FIG. 6.

In the modified pintle 10' of FIG. 6 additional spring power is provided by employment of a substantially cylindrical plug 50 of a suitable elastomer which is capable of storing energy when compressed for subsequent release when the plug is able to expand. The plug is made in a solid cylindrical form extending for most of the length of the torsion coiled spring 23 intermediate the respective upper and lower tapered projections 24 and 25 as shown in FIG. 6.

For winding up the spring, namely to provide a predetermined tension condition, one end of the spring may be rotated while the opposite end is held fixed or in any event one end of the spring is given a contra rotation with respect to the other. This results in storing energy in an amount depending upon several factors among which is the size of the spring and the physical character of the material of which it is made.

Winding up a spring in the manner suggested causes a change of the physical size of the spring. Let it be assumed, for example, that a helical wound spring motor such as that shown has coils wound relatively close together in a form providing a mean diameter D, an overall active length L, a wire diameter $d$ and a wire length $l$. Active length in the example means that portion of the spring not secured to the respective upper and lower projections 24 and 25 and consists of a total number of coils indicated as M. On this premise:

$$N=L-d/d$$

Energizing the spring by a further wind up rotation of a given number of turns where T equals the number of turns will result in a reduction of D to D$l$, and an increase in the length L to L$l$ as follows:

$$Dl= D \times (N/N+T)$$

and:

$$Ll=L+Td$$

Therefore, in the chosen example a spring closely wound with a diameter of 0.500 inches and a length of 2.000 inches, consisting of 19 coils, and made from a wire of diameter 0.100 inches, once subjected to a one turn wind up, namely 360°, will have its diameter D decreased to 0.475 inches and its length increased to 2.100 inches.

By application of the example to the present invention, when the spring is wound up the decrease in diameter D causes an increasing grip between the close wound coils at the opposite ends where they engage the respective tapered projections.

By reference to the drawing, FIG. 2 for example, it will be clear that the relationship of the parts does not allow for any axial movement of the connecting member 21 in an upward direction nor a downward movement of the lower end piece 22. Consequently the spring 23 cannot in fact increase in length when wound up as suggested by the example. To compensate for this condition spaces 24 have been provided between adjacent coils of the spring. These spaces absorb the increase in the number of coils which in the present instance is one coil more. In other words, the spaces absorb the increase in spring length when subjected to wind up.

The tubular housing 31 and the upper end piece 20 are maintained in fixed relationship as has been described and the lower end piece 22 has a rotatable relationship with respect to the tubular housing 31 and provides a radial and thrust bearing therebetween. The bearing relationship may be enhanced if desired by providing an anti-friction stepped washer 52 between mutually rotating parts.

With the respective parts of the composite pintle secured, one to one leaf hinge and one to the other as described, movement of either or both of the hinge leaves in one selected direction will impart a wind up of the coil spring 23, press fitted as it is to the respective upper and lower tapered projections 24 and 25. The ratchet teeth 26 and 27 permit rotation of the connecting member in one direction but block rotation in the opposite direction. The direction is such as to allow the spring to be partially wound up by employment of a hexagonal wrench 29 inserted through the aperture 30 into engagement with the socket 28 to provide a preload which will hold the elements in place.

In the chosen embodiment the spaces 44 are calculated so as to provide in addition to the change in length from wind up the capability of absorbing the required axial movement of the connecting member 21 when upon rotation it is shifted downwardly as shown in FIG. 2 for example by action of the ratchet teeth. The overall length of the coil spring 23 is further calculated to provide an initial bias axially against the connecting member 21 to retain the ratchet teeth normally in engagement.

Let it be assumed for example that the hinge as illustrated in FIG. 1 is applied to a lefthand door installation where the male leaf 12 is fastened to the frame and the female leaf 11 is fastened to the door hinge. In this example opening the door, in a counterclockwise direction in FIG. 1, will cause the spring to wind up. As a consequence energy stored by the winding up will tend to close the door when released.

The total amount of energy necessary to close the door is dependent upon factors which as the size and weight of the door. It may be desirable on some occasions to employ two or three, or in some cases even more such spring motor hinges. Normally all of the springs will be preloaded sufficient so that the parts of the composite spindle will maintain their assembled relationship. Added spring tension can be adjusted as to each of the springs as occasion requires.

Spring loading can also be diminished by merely pressing downwardly against the connecting member 21 by use of a hexagonal wrench 29 sufficient to have the ratchet teeth clear and permit rotation of the connecting member in a direction the reverse of that needed for increasing tension on the spring.

Having described the invention, what is claimed as new in support of Letters Patent is:

1. A separate torsion spring motor unit, for action between pivotally mounted elements, comprising a cylindrical housing having an elongated chamber therein, a coiled torsion spring in said chamber, a first spring keeper having an attachment to one end of the spring at an adjacent end of the chamber and having a rotatable mounting relative to said housing, a spring tension subassembly comprising a second spring keeper having an attachment to the other end of the spring and rotatable relative to said housing, a plug fixed to the end of the housing adjacent said second spring keeper, detent means comprising elements respectively on said plug and said second spring keeper, means on said second spring keeper enabling rotation of said second spring keeper to vary tension in said spring, and access means past said plug to said means on said second spring keeper, said detent means having a blocking engagement in one rotational direction whereby to maintain spring tension and being yieldable in the opposite rotational direction whereby to enable rotation to increase spring tension, said detent means being yieldable in an axial direction whereby to enable a release of detent action and effect a variable decrease in spring tension.

2. A separate torsion spring motor unit according to claim 1 wherein said detent means comprises ratchet teeth respectively on said spring keeper and said plug having ramps enabling mutual rotation in a direction for increasing tension in said spring and shoulders blocking mutual rotation in the opposite direction.

3. A separate torsion spring motor unit according to claim 1 wherein there is a wrench hold in said second spring keeper and a passageway through said plug in axial alignment with said wrench hold for reception of a wrench.

4. A separate torsion spring motor unit according to claim 1 wherein the attachments of said spring keepers to said spring each comprise a tapered projection extending into the respective end of the spring and a plurality of coils of the spring in close association with each other and held by spring tension in engagement with the projection.

5. A separate torsion spring motor unit according to claim 4 wherein the projection of each spring keeper forms an annular pocket with the adjacent end of the housing and coils of the spring in engagement with the projection reside in the pocket.

6. A separate torsion spring motor unit according to claim 1 wherein there is a pair of hinge leaves which comprise said pivotally mounted elements, said pair of hinge leaves having axially aligned knuckles, each said knuckle having a pivot chamber in axial alignment with the pivot chamber of the other knuckle, said pivot chambers jointly comprising a receptacle for the cylindrical housing of said torsion spring motor unit.

7. A separate torsion spring motor unit according to claim 6 wherein said first spring keeper is anchored to one of said knuckles and wherein said cylindrical housing and said plug are jointly anchored to the other of said knuckles.

8. A separate torsion spring motor unit as in claim 1 wherein there is a resilient mass within the coiled torsion spring yieldable in response to build-up pressure in said coiled torsion spring for storing spring energy for subsequent release.

9. A separate torsion spring motor as in claim 8 wherein said mass is a cylindrical elastomer core with the exterior thereof in engagement with the interior of said coil torsion spring.

10. A separate torsion spring motor as in claim 1 wherein there is an antifriction washer between said housing and said first spring keeper.

11. A separate torsion spring motor as in claim 10 wherein said antifriction washer has portions acting both axially and radially between the housing and the first spring keeper whereby to provide bearing support in both thrust and lateral directions.

* * * * *